US009360022B2

(12) United States Patent
Michligk

(10) Patent No.: US 9,360,022 B2
(45) Date of Patent: Jun. 7, 2016

(54) RADIAL COMPRESSOR AND METHOD FOR PRODUCING A RADIAL COMPRESSOR

(75) Inventor: Thomas Michligk, Berlin (DE)

(73) Assignee: MAN Diesel & Turbo SE, Augsburg (DE)

( * ) Notice: Subject to any disclaimer, the term of this patent is extended or adjusted under 35 U.S.C. 154(b) by 801 days.

(21) Appl. No.: 13/387,911

(22) PCT Filed: Jul. 21, 2010

(86) PCT No.: PCT/DE2010/050050
§ 371 (c)(1),
(2), (4) Date: Jan. 30, 2012

(87) PCT Pub. No.: WO2011/012128
PCT Pub. Date: Feb. 3, 2011

(65) Prior Publication Data

US 2012/0128477 A1 May 24, 2012

(30) Foreign Application Priority Data

Jul. 31, 2009 (DE) ..... 10 2009 035 573

(51) Int. Cl.
*F04D 29/44* (2006.01)
*F04D 29/62* (2006.01)
*F04D 17/10* (2006.01)

(52) U.S. Cl.
CPC ..... *F04D 29/441* (2013.01); *F04D 17/10* (2013.01); *F04D 29/624* (2013.01); *Y10T 29/49243* (2015.01)

(58) Field of Classification Search
CPC ..... F04D 29/441; F04D 29/624; Y10T 29/49243
USPC ..... 415/198.1, 199.1–199.3, 208.3, 211.1, 415/211.2, 224.5, 225, 226, 207, 196, 204, 415/206; 29/888.02, 888.024, 557, 525.14
See application file for complete search history.

(56) References Cited

U.S. PATENT DOCUMENTS

| | | | | |
|---|---|---|---|---|
| 2,708,883 | A * | 5/1955 | Keller et al. | 415/199.3 |
| 2,977,042 | A * | 3/1961 | Jassniker | 415/206 |
| 3,103,892 | A * | 9/1963 | McFarland | 415/199.3 |
| 3,873,232 | A * | 3/1975 | Stein et al. | 415/207 |

(Continued)

FOREIGN PATENT DOCUMENTS

| | | |
|---|---|---|
| CN | 1061081 | 5/1992 |
| CN | 101365883 | 2/2009 |

(Continued)

*Primary Examiner* — Christopher Verdier
(74) *Attorney, Agent, or Firm* — Cozen O'Connor

(57) ABSTRACT

A radial compressor has a compressor housing, a rotatably supported compressor shaft in the compressor housing, at least one compressor impeller arranged on the compressor shaft, and a fluid discharge element arranged downstream of a last compressor impeller in a fluid path in the compressor housing and which has a predetermined extension in radial direction and in axial direction of the radial compressor, wherein the fluid discharge element has a fluid passage for guiding fluid that is accelerated by the last compressor impeller out of the compressor housing, which fluid passage extends in a circumferential direction by a predetermined angular amount, and wherein the fluid discharge element is formed of material having a defined material structure, and the fluid passage is formed as a subsequently introduced spatial interruption in a material cohesion of the material structure. A method of producing the radial compressor is also disclosed.

16 Claims, 4 Drawing Sheets

(56) References Cited

U.S. PATENT DOCUMENTS

| | | | | |
|---|---|---|---|---|
| 3,930,746 | A | 1/1976 | Kronogard | |
| 4,012,166 | A | 3/1977 | Kaesser et al. | |
| 4,027,997 | A * | 6/1977 | Bryans | 415/207 |
| 4,536,128 | A | 8/1985 | Feldle et al. | |
| 4,595,340 | A | 6/1986 | Klassen et al. | |
| 5,131,142 | A * | 7/1992 | Brasz | 29/888.02 |
| 5,529,457 | A | 6/1996 | Terasaki et al. | |
| 8,105,025 | B2 * | 1/2012 | Albrecht et al. | 415/196 |
| 2010/0202878 | A1 * | 8/2010 | Wacker et al. | 415/208.1 |

FOREIGN PATENT DOCUMENTS

| | | | | |
|---|---|---|---|---|
| DE | 968 101 | | 1/1958 | |
| DE | 32 32 326 | | 3/1984 | |
| DE | 10 2007 042 529 | A1 * | 3/2009 | F01D 9/00 |
| EP | 0 484 110 | | 5/1992 | |
| JP | 01-108301 | | 7/1989 | |
| SU | 323570 | | 12/1971 | |
| SU | 1194291 | A3 | 1/1985 | |
| WO | WO 2009/033549 | | 3/2009 | |
| WO | WO 2009/144102 | A1 * | 12/2009 | F04D 29/42 |

* cited by examiner

RADIAL COMPRESSOR AND METHOD FOR PRODUCING A RADIAL COMPRESSOR

PRIORITY CLAIM

This is a U.S. national stage of application No. PCT/DE2010/050050, filed on Jul. 21, 2010. Priority is claimed on the following applications: Country: Germany, Application No.: 10 2009 035 573.1, Filed: Jul. 31, 2009, the content of which is incorporated herein by reference.

FIELD OF THE INVENTION

The present invention is directed to a radial compressor and to a method of producing a radial compressor.

BACKGROUND OF THE INVENTION

A radial compressor and a method of the type mentioned above are known from WO 2005/045201 A1.

For purposes of guiding flow, single-stage and multistage radial compressors in which one or more compressor impellers are arranged on a compressor shaft in a compressor housing of the respective radial compressor have stator component parts which surround the compressor impellers of the respective radial compressor and which are arranged in layers or one behind the other in an axial direction of the radial compressor and together form a stator assembly of the radial compressor.

The last stator component part of every stage contains a fluid passage which collects the fluid to be compressed and supplies it to a discharge nozzle through which the fluid exits the compressor housing and is supplied to a subsequent process. This fluid passage, which accordingly serves to guide out fluid that is accelerated by the last compressor impeller, can be constructed as a collector space or as a spiral space.

Spiral space refers to a space which develops or increases in cross section over the circumference of the radial compressor and final stator part, respectively, and into which the fluid or medium which is, e.g., gaseous or liquid is introduced via a diffuser and then guided out of the compressor housing at a greatest cross section of the spiral space. In contrast, collector space refers to a space having a constant cross section over the circumference of the radial compressor and final stator part, respectively, and the fluid which is, e.g., gaseous or liquid is guided into the space via the diffuser and guided out of the compressor housing at any location or at a desired location.

FIG. 1 shows a schematic view of a construction of a radial compressor 1' corresponding to the prior art using the example of a single-stage barrel compressor.

According to FIG. 1, gaseous fluid, for example, is guided into a compressor impeller 13' rotating along with a compressor shaft 20' in a compressor housing 10' of the radial compressor 1' via a fluid inlet 12' formed by the compressor housing 10' and an inlet insert 11' and is conveyed out of the compressor impeller 13' radially into a diffuser passage 16' which is limited by an inner part 14' and a spiral/collector space body 15' and which guides the fluid into a spiral/collector passage **15*a*' (a fluid passage for guiding out fluid that is accelerated by the last compressor impeller) which is formed in the spiral/collector space body 15'. The fluid is guided to a fluid outlet 17' of the compressor housing 10' via the spiral/collector passage 15*a*'** and is supplied to a subsequent process.

A collector space body or spiral space body of this kind which has a collector passage or spiral passage and which forms a fluid discharge element of a radial compressor is commonly produced as a casting, the collector passage or spiral passage being generated, e.g., by casting cores. However, castings have drawbacks with regard to their lengthy delivery times and the models required for manufacture, which in many cases cannot be reused and which add substantially to production costs for the castings, and with respect to the quality thereof which may vary.

Variations in quality particularly affect dimensional stability (in this case, the dimensional stability of the collector passage or spiral passage in particular) and material structure which, in the case of castings, can be impaired particularly by casting defects. Casting defects can in turn lead to cracks and to machining problems or can even make it necessary to scrap the entire casting.

As a result, radial compressors which are outfitted with conventional fluid discharge elements of this kind are problematic for manufacturers of this type of compressor as far as maintaining the required operating characteristics such as operational reliability or fail-safety and meeting agreed-upon delivery times. Accordingly, the production of radial compressors of this kind can entail high cost risks for the producer which manifest themselves, e.g., in contract penalties, increased procurement costs and/or transportation costs, and so on. Moreover, conventional radial compressors of this type are problematic with respect to standardization and thus with respect to cost optimization of the production process.

It is an object of the present invention to provide a radial compressor of the type mentioned above which has improved operating characteristics over conventional radial compressors and which can be produced with fewer cost risks. It is a further object of the invention to provide a process for the production of a radial compressor of this kind.

SUMMARY OF THE INVENTION

According to a first aspect of the invention, a radial compressor has a compressor housing, a compressor shaft which is rotatably supported in the compressor housing, at least one compressor impeller which is arranged on the compressor shaft in the compressor housing, and a fluid discharge element which is arranged downstream of a last compressor impeller of the radial compressor in a fluid path in the compressor housing and which has a predetermined extension in a radial direction and in an axial direction of the radial compressor.

According to the invention, the fluid discharge element has a fluid passage for guiding fluid that is accelerated by the last compressor impeller out of the compressor housing, which fluid passage extends in a circumferential direction of the radial compressor by a predetermined angular amount, this fluid discharge element being formed of material having a defined material structure. The radial compressor according to the invention is characterized in that the fluid passage is formed, particularly in its entirety, as a subsequently introduced spatial interruption in a material cohesion of the material structure.

According to an embodiment of the invention, the angular amount can be at least 90 degrees or at least 180 degrees or at least 270 degrees or approximately or exactly 360 degrees.

By defined material structure is meant, according to the present invention, that a starting material for the fluid discharge element is in a solid state and expressly not in a molten state, wherein the totality of all structural irregularities and structural regularities forms the material structure. In other words, the fluid passage forming a collector passage or a spiral passage is produced, particularly in its entirety, by the separation of particles of material from, in particular, solid or massive starting material so that a number of particles and a volume of the finished fluid discharge element are less than that of the starting material.

A spatial interruption or cancelation of the material cohesion of such a defined material structure of the fluid discharge element such as is provided according to the invention can be achieved exclusively by separating machining, e.g., dividing, chip removal (e.g., milling, drilling, turning, grinding, etc.), removal (e.g., electric discharge machining, laser cutting, electron beam cutting, thermal cutting, etc.) and so on.

However, substantially higher accuracies can be achieved, particularly also for the fluid passage for guiding out fluid accelerated by the last compressor impeller, by a separating method using, e.g., currently available CNC (Computer Numerically Controlled) machines such as, for example, CNC milling machines, CNC electric discharge machines, etc. Production of the fluid passage by means of casting cores, which is cost-intensive, laborious and variable with respect to quality, can be dispensed with in this way.

Therefore, due to the fact that the fluid passage for guiding out fluid accelerated by the last compressor impeller is produced with invariably consistent quality and dimensional stability, a radial compressor having a fluid discharge element produced according to the present invention always has the desired, and therefore improved, operating characteristics. The cost risks in producing the radial compressor are reduced overall because of the reduced risks with respect to contract penalties relating to delivery times and/or quality and/or the higher procurement costs and/or higher transportation costs for the producer of a radial compressor of this kind.

According to an embodiment of the radial compressor according to the present invention, the fluid discharge element is formed by a plurality of discharge element parts which are stacked one upon the other and connected to one another in axial direction of the radial compressor. The discharge element parts are preferably welded, soldered or screwed to one another. In addition, suitable connections to the compressor housing and adjacent inner parts of the radial compressor can be provided as is common, e.g., in barrel compressors or horizontally split radial compressors.

The lamination or stacking of a plurality of discharge element parts one on top of the other according to the present invention has the advantage that the total extension of the fluid discharge element in axial direction of the radial compressor can be distributed among the plurality of thickness dimensions or extensions of the discharge element parts in axial direction of the radial compressor. Therefore, the starting material to be used for the respective discharge element parts is not subject to the limitations or minimum size requirements predetermined by the fluid discharge element as a whole, at least in one dimension, namely, in this case, preferably in the thickness dimension extending in axial direction of the radial compressor. This ensures a greater flexibility with respect to the basic dimensions of the starting material for the respective discharge element parts.

According to an embodiment of the radial compressor according to the present invention, the fluid passage extends into at least two discharge element parts of the plurality of discharge element parts.

Accordingly, by stacking one on top of the other in accordance with the present invention, it is possible to distribute the cross section among a plurality of discharge element parts when a commercially available thickness dimension of the starting material for the respective discharge element parts is not sufficient to form the entire cross section of the fluid passage therein. Therefore, the person skilled in the art is substantially freed from any constraints stemming from starting material when designing the fluid passage or fluid discharge element and can accordingly realize an optimal design.

It should be noted in this connection that the fluid passage can extend into a plurality of discharge element parts both based on its cross section and based on any possible axial path factors, wherein the fluid passage extends helically in axial direction of the fluid discharge element.

According to an embodiment of the radial compressor according to the present invention, a cross section of the fluid passage is constant along its extension in circumferential direction.

According to this embodiment of the fluid passage, the fluid passage serves as a collector space according to the above definition.

According to an embodiment of the radial compressor according to the present invention, a cross section of the fluid passage increases along its extension in circumferential direction so that a fluid outlet of the fluid passage is arranged at a greatest cross section thereof.

According to this embodiment of the fluid passage, the fluid passage serves as a spiral space according to the above definition.

According to an embodiment of the radial compressor according to the present invention, the material of the fluid discharge element is compression-formed material, and the material structure of the fluid discharge element is formed as a compression-formed material structure.

By compression-formed material is meant, according to the invention, for example, forged material, cold rolled material and hot rolled material, drawn material, etc. Materials of this kind are commercially obtainable quickly and inexpensively as semifinished products. Further, compression-formed materials have an improved material structure with respect to air inclusions because, as a result of the compression forming, any possible air inclusions present after primary shaping are worked out, as it were, and therefore a more homogeneous material structure is generated.

The material of the fluid discharge element is preferably rolled material, particularly sheet metal or metal plate, and the material structure of the fluid discharge element is formed as rolled material structure.

In particular, sheet metals or metal plates are commercially available in a large variety of sheet metal or metal plate thicknesses and material qualities. The problem of limited commercially available sheet metal or metal plate thicknesses is solved in a simple manner by the stacking of a plurality of discharge element parts one upon the other according to the invention.

In other words, when the thickness dimensioning of the fluid discharge element exceeds commercially available sheet metal or metal plate thicknesses, a plurality of metal sheets or metal plates (discharge element parts) are simply stacked one on top of the other and connected to one another as was described above. The geometric shape for the fluid passage can be generated in every metal sheet or metal plate individually or in the metal sheets or metal plates in the stacked state.

As a result of the inventive construction of the fluid discharge element from a plurality of discharge element parts, standardized discharge element parts can be defined for certain compressor sizes so that at least the starting material for the latter, and possibly even finished discharge element parts, can be stocked in a warehouse. In this way, radial compressors according to the invention can have a higher degree of standardization so that a cost optimization of the production process can be achieved. Further, by stocking determined discharge element parts it is possible to respond rapidly and flexibly to customer demands.

According to a second aspect of the invention, a process for the production of a radial compressor has at least the following steps: a compressor housing is provided; a compressor shaft is provided; at least one compressor impeller is provided and is arranged on the compressor shaft; the compressor shaft is rotatably supported in the compressor housing; and a fluid discharge element is provided and is arranged in a fluid path in the compressor housing downstream of a last compressor impeller of the radial compressor; wherein the fluid discharge element has a determined extension in a radial direction and in an axial direction of the radial compressor and has a fluid passage for guiding fluid which is accelerated by the last compressor impeller out of the compressor housing, which fluid passage extends by a defined angular amount in a circumferential direction of the radial compressor. The method according to the invention is characterized in that the fluid passage, particularly in its entirety, is arranged in the fluid discharge element by means of separating machining when providing the fluid discharge element.

According to an embodiment of the invention, the angular amount can be at least 90 degrees or at least 180 degrees or at least 270 degrees or approximately or exactly 360 degrees.

Separating machining according to the invention can comprise, e.g., dividing and/or chip removal (e.g., milling, drilling, turning, grinding, etc.) and/or removal (e.g., electric discharge machining, laser cutting, electron beam cutting, thermal cutting, etc.).

Substantially higher accuracies can be achieved, particularly also for the fluid passage for guiding out fluid accelerated by the last compressor impeller, by a separating method using currently available CNC (Computer Numerically Controlled) machines such as, for example, CNC milling machines, CNC electric discharge machines, etc. Production of the fluid passage by means of casting cores, which is cost-intensive, laborious and variable with respect to quality, can be dispensed with in this way.

By means of the method according to the invention, the fluid discharge element and the fluid passage thereof for guiding out fluid accelerated by the last compressor impeller can be produced with invariably consistent quality and dimensional stability so that the desired operating characteristics can be guaranteed. The cost risks in producing the radial compressor are reduced overall because, e.g., the risks with respect to contract penalties relating to delivery times and/or quality are reduced for the producer of a radial compressor.

According to an embodiment of the method according to the invention, solid or massive material is used as starting material for the fluid discharge element.

In other words, any suitable commercially available solid material can be used as starting material because the fluid passage in its entirety is worked out of the solid whole by separating machining only subsequently.

According to an embodiment of the method according to the invention, the fluid passage is generated in the fluid discharge element by chip-removing and/or material removal machining.

Machining methods carried out by CNC machines such as milling, electric discharge machining, laser cutting, electron beam cutting and thermal cutting are suited precisely for three-dimensional geometries such as the fluid passage. Accordingly, the geometry of the fluid passage can be reliably produced with reproducible quality and high dimensional stability.

According to an embodiment of the method according to the invention, a plurality of separate discharge element parts are stacked one upon the other and connected to one another when providing the fluid discharge element in such a way that the discharge element parts are arranged one after the other or adjacent to one another in axial direction of the radial compressor. The discharge element parts are preferably connected to one another, in particular welded, soldered or screwed to one another. In addition, suitable connections to the compressor housing and adjacent inner parts of the radial compressor can be provided as is common, e.g., in barrel compressors or horizontally split radial compressors.

The lamination or stacking of a plurality of discharge element parts one on top of the other according to the present invention has the advantage that the total extension of the fluid discharge element in axial direction of the radial compressor can be distributed among the plurality of thickness dimensions or extensions of the discharge element parts in axial direction of the radial compressor. Therefore, the starting material to be used for the respective discharge element parts is not subject to the limitations or minimum size requirements predetermined by the fluid discharge element as a whole, at least in one dimension, namely, in this case, preferably in the thickness dimension extending in axial direction of the radial compressor. This ensures a greater flexibility with respect to the basic dimensions of the starting material for the respective discharge element parts.

According to an embodiment of the method according to the invention, the fluid passage is generated in such a way that it extends into at least two discharge element parts of the plurality of discharge element parts.

Accordingly, by stacking one on top of the other in accordance with the invention, it is possible to distribute the cross section among a plurality of discharge element parts when a commercially available thickness dimension of the starting material for the respective discharge element parts in not sufficient to form the entire cross section of the fluid passage therein. Therefore, the person skilled in the art is substantially freed from any constraints arising from starting material when designing the fluid passage or fluid discharge element and can accordingly realize an optimal design.

It should be noted in this connection that the fluid passage can be generated so as to be distributed among a plurality of discharge element parts both based on its cross section to be realized and based on any possible axial path factors to be realized, wherein the fluid passage extends helically in axial direction of the fluid discharge element.

According to an embodiment of the method according to the invention, the fluid passage is generated in such a way that a cross section of the fluid passage is constant along its extension in circumferential direction.

In other words, the fluid passage is constructed as a collector space according to the above definition.

According to an embodiment of the method according to the invention, the fluid passage is generated in such a way that a cross section of the fluid passage increases along its extension in circumferential direction so that a fluid outlet of the fluid passage is arranged at a greatest cross section thereof.

In other words, the fluid passage is constructed as a spiral space according to the above definition.

According to an embodiment of the method according to the invention, compression-formed material is used as starting material for the fluid discharge element.

As was mentioned above, compression-formed material according to the invention designates, for example, forged material, cold rolled material and hot rolled material, drawn material, etc. Materials of this kind are commercially obtainable quickly and inexpensively as semifinished products. Further, compression-formed materials have an improved material structure with respect to air inclusions because, as a result of the compression forming, any possible air inclusions present after primary shaping are worked out, as it were, and therefore a more homogeneous material structure is generated.

According to an embodiment of the method according to the invention, rolled material, particularly sheet metal or metal plate, is used as starting material for the fluid discharge element.

In particular, sheet metals or metal plates are commercially available in a large variety of sheet metal or metal plate thicknesses and material qualities. The problem of limited commercially available sheet metal or metal plate thicknesses is solved in a simple manner by the stacking of a plurality of discharge element parts one upon the other according to the invention.

In other words, when the thickness dimensioning of the fluid discharge element exceeds commercially available sheet metal or metal plate thicknesses, a plurality of metal sheets or metal plates (discharge element parts) are simply stacked one on top of the other and connected to one another as was described above. The geometric shape for the fluid passage can be generated in every metal sheet or metal plate individually or in the metal sheets or metal plates in the stacked state.

As a result of the inventive production of the fluid discharge element from a plurality of discharge element parts, standardized discharge element parts can be defined for certain compressor sizes so that at least the starting material for the latter, and possibly even finished discharge element parts, can be stocked in a warehouse. In this way, radial compressors according to the invention can have a higher degree of standardization so that a cost optimization of the production process can be achieved. Further, by stocking determined discharge element parts it is possible to respond rapidly and flexibly to customer demands.

Finally, according to an embodiment of both aspects of the invention it is proposed that the castings for collector space and/or spiral space be replaced by structural component parts which are produced from at least one metal sheet or metal plate or metal sheets or metal plates predominantly by chip removal. Given a suitable shaping of the flow-guiding fluid passages for collector space and spiral space, respectively, they can be produced from a metal sheet or metal plate or, when the available sheet metal or metal plate thickness is insufficient, a plurality of stacked metal sheets or metal plates by chip removal and/or by erosive methods and/or by cutting methods (laser, electron beam, thermal cutting).

When the metal sheets or metal plates are stacked, they can be screwed, soldered or welded to one another. When the metal sheets or metal plates are screwed to one another, the screw fastening can also be a component part of the screw fastening of the stator assembly in its entirety.

The invention allows not only the use of metal sheets or metal plates but also makes it possible to construct a system of standardized structural component parts.

The invention is not limited to single-stage radial compressors; rather, the invention is also applicable, for example, to multistage barrel-type or horizontally split radial compressors.

According to an embodiment of the invention, the radial compressor is a single-shaft radial compressor.

BRIEF DESCRIPTION OF THE DRAWINGS

The invention will be described in the following with reference to the accompanying drawings in which.

DETAILED DESCRIPTION OF THE PRESENTLY PREFERRED EMBODIMENTS

A radial compressor 1 according to an embodiment of the present invention will be described in the following with reference to FIGS. 2, 3A and 3B.

Figure 1:
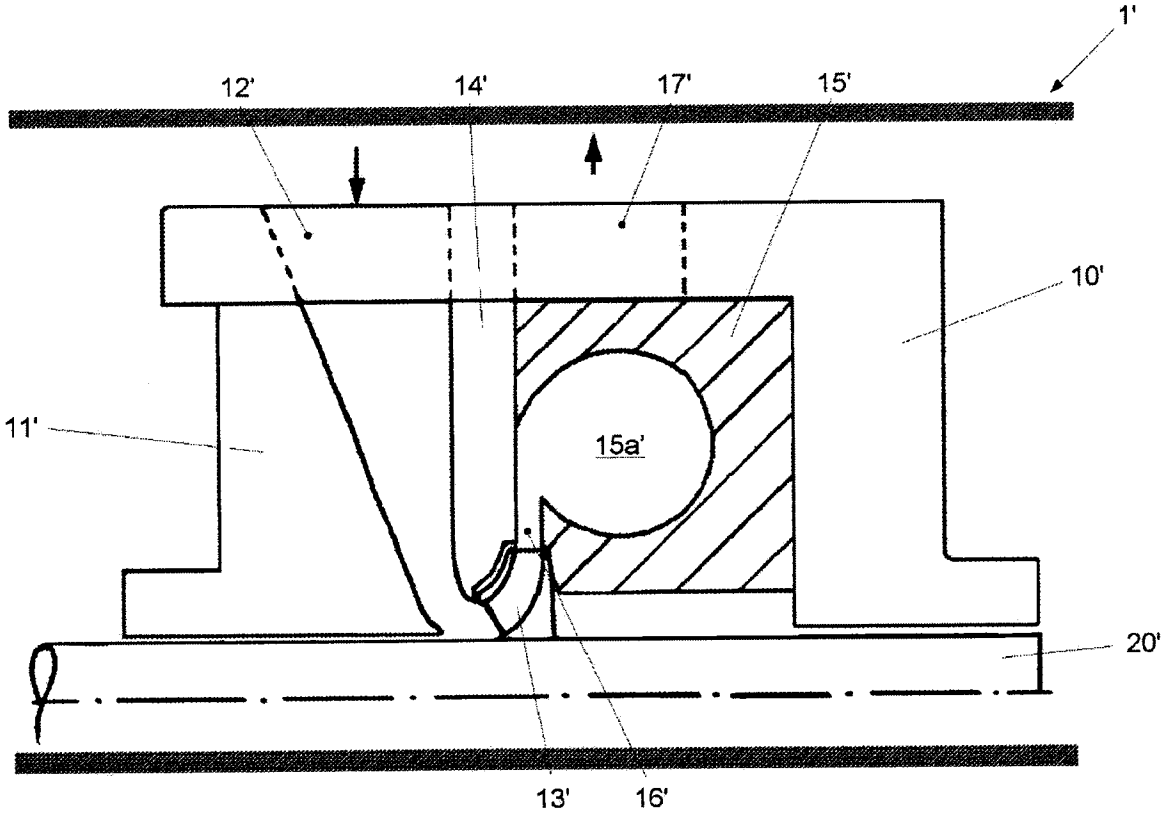
FIG. 1 is a schematic sectional view of a radial compressor according to the prior art.
Figure 2:
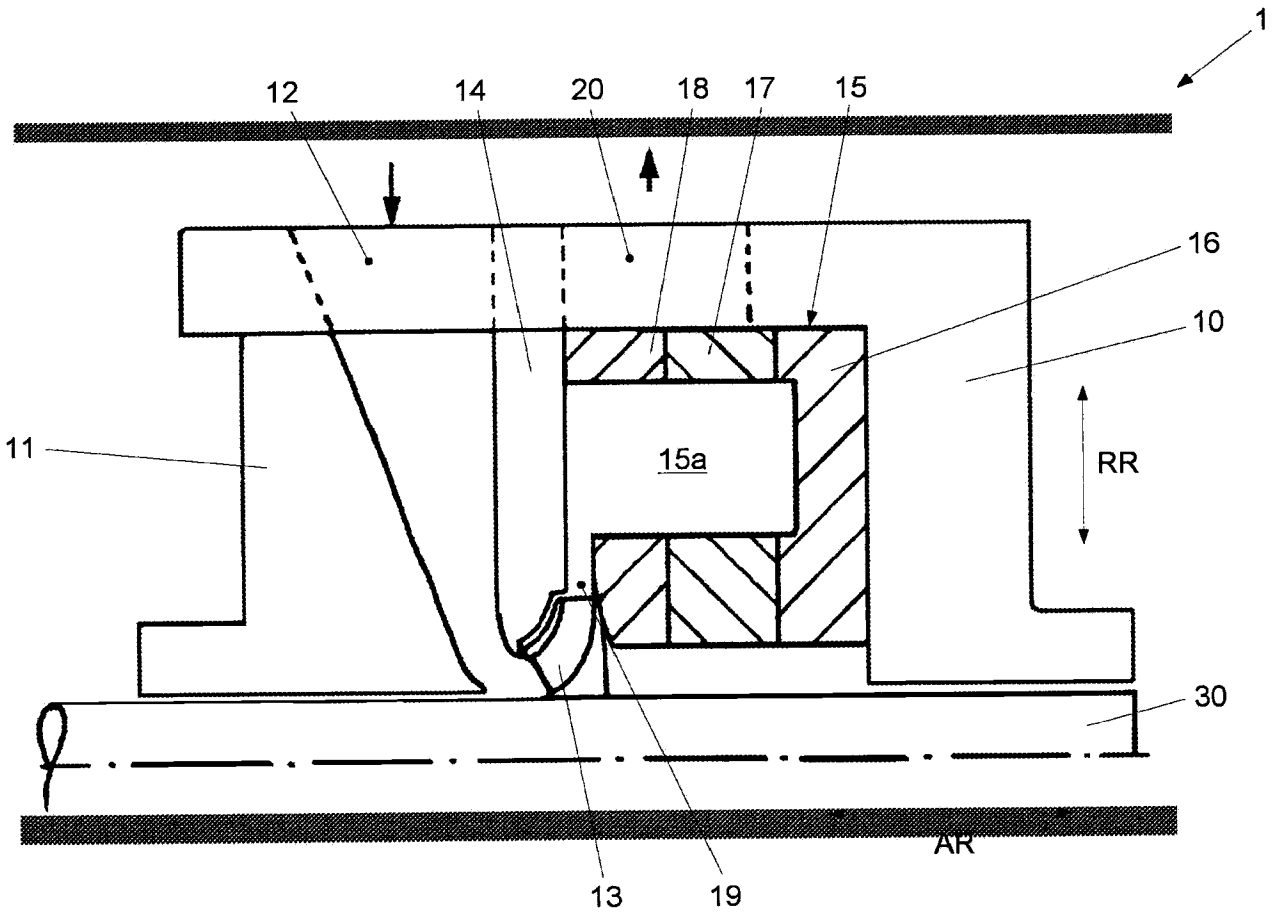
FIG. 2 is a schematic sectional view of a radial compressor according to an embodiment of the present invention.
Figure 3A:
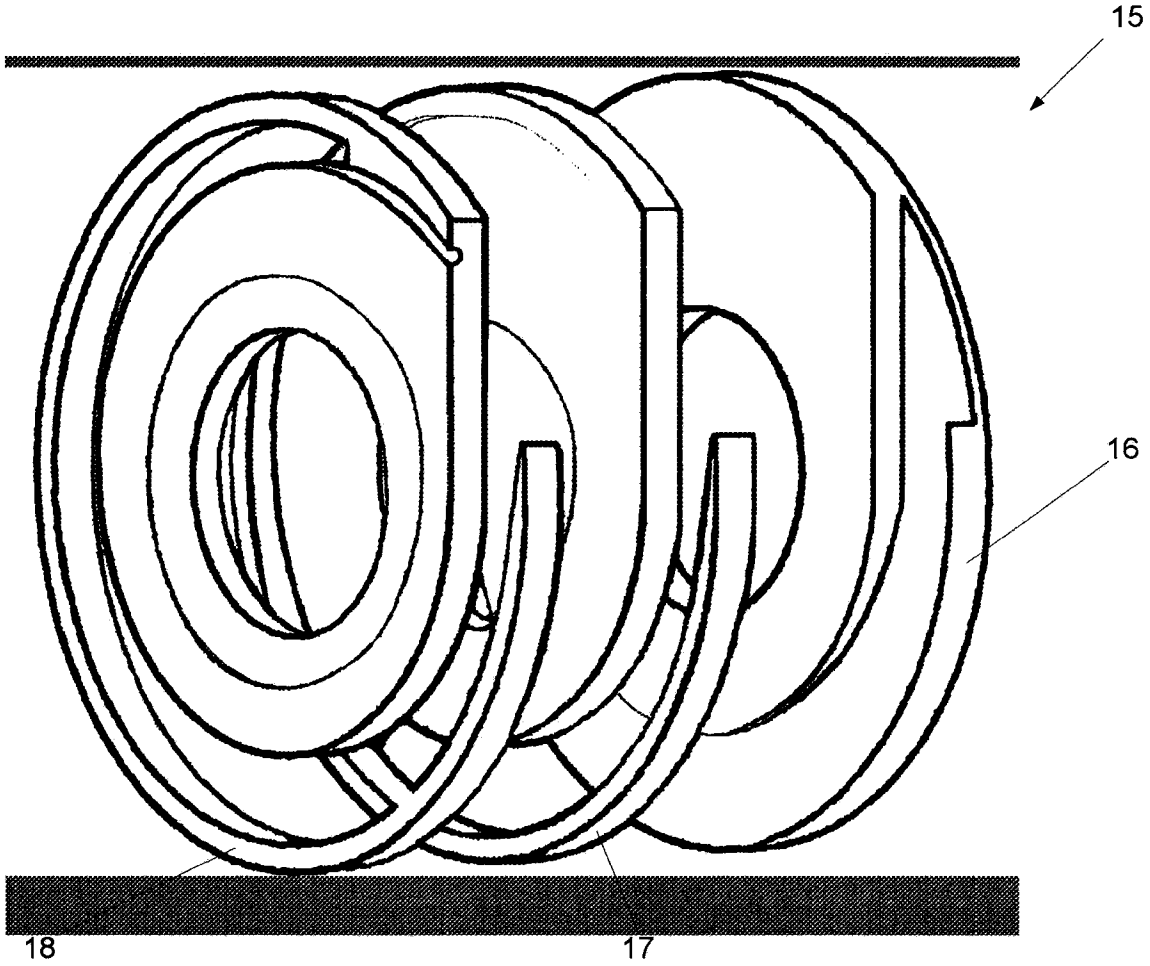
FIG. 3A is a perspective exploded view of a fluid discharge element of a radial compressor according to an embodiment of the present invention.
Figure 3B:
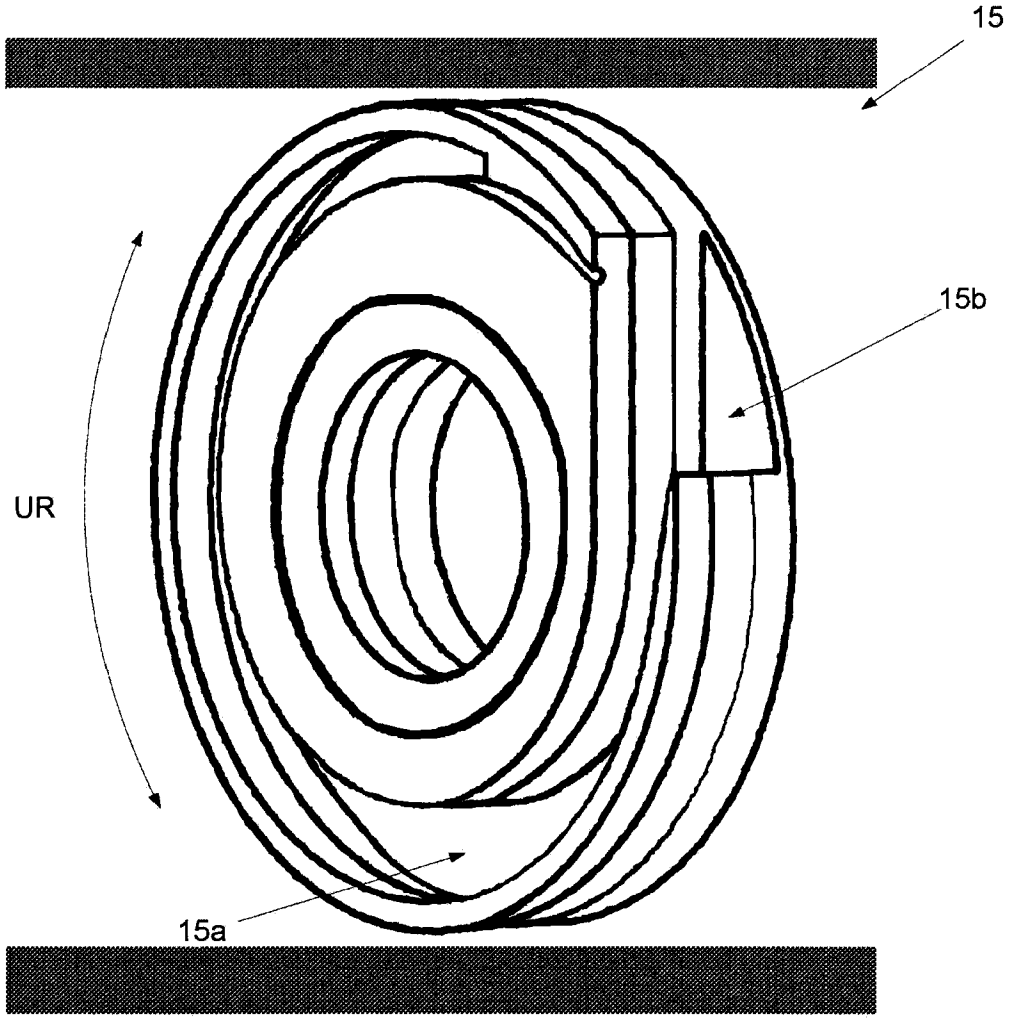
FIG. 3B is a perspective assembly view of the fluid discharge element shown in FIG. 3A.

As is shown in FIGS. 2, 3A and 3B, the radial compressor 1 has a compressor housing 10, a compressor shaft 30 which is rotatably supported in the compressor housing 10, a fluid inlet 12 for the intake or suction of liquid or gaseous fluid, which fluid inlet 12 is formed by the compressor housing 10 and an inlet insert 11, a compressor impeller 13 which is fastened to or supported on a compressor shaft 30, a diffuser passage 19 which is defined by an inner part 14 and a fluid discharge element 15, a fluid passage 15*a* formed in the fluid discharge element 15 for guiding out fluid which is accelerated via the compressor impeller 13, and a fluid outlet 20 in the compressor housing 10.

As can be seen particularly from FIG. 2, the compressor impeller 13, in this case an individual compressor impeller 13, simultaneously forms a last compressor impeller of the radial compressor 1 in a fluid path in the compressor housing 10, wherein the fluid discharge element 15 is supported downstream of the compressor impeller 13 in the fluid path.

The fluid discharge element 15 has a defined extension in a radial direction RR and in an axial direction AR of the radial compressor 1. As can be seen from FIGS. 2, 3A and 3B, the fluid discharge element 15 is formed by three discharge element parts 16, 17, 18 which are stacked one on top of the other and connected to one another in axial direction AR of the radial compressor 1. The discharge element parts 16, 17, 18 are welded, soldered or screwed together (not shown in detail).

The fluid passage 15*a* extends into all three of the discharge element parts 16, 17, 18 so that the fluid passage 15*a* extends in a circumferential direction UR (see FIG. 3B) of the radial compressor 1 and the fluid discharge element 15, respectively, by a predetermined angular amount which is about 360 degrees in the present case.

As can be seen particularly from FIG. 3A and FIG. 3B, a cross section of the fluid passage 15*a* increases along its extension in circumferential direction UR so that a fluid outlet 15*b* of the fluid passage 15*a* communicating with the fluid outlet 20 in the compressor housing 10 is arranged at a greatest cross section of the fluid passage 15*a*.

According to an alternative embodiment which is not shown, the cross section of the fluid passage 15*a* is constant or has the same size along its extension in circumferential direction UR.

The fluid discharge element 15 is produced from a material having a defined material structure, namely, according to an embodiment of the invention, from compression-formed material and, in the present case, in particular from rolled sheet metal or metal plate. In other words, the material structure of the fluid discharge element 15 and of the respective discharge element parts 16, 17, 18 is a compression-formed material structure and, in the present case, particularly a rolled material structure.

According to the invention, the fluid passage 15*a* is generated in the solid starting material (sheet metal or metal plate) of the fluid discharge element 15 by separating machining.

Accordingly, the fluid passage 15*a* is a subsequently generated spatial interruption in a material cohesion of the material structure of the fluid discharge element 15.

In simplest form, a method of producing the radial compressor 1 accordingly comprises the following steps: providing the compressor housing 10; providing the compressor shaft 30; providing the compressor impeller 13 and arranging the same on the compressor shaft 30; supporting the compressor shaft 30 rotatably in the compressor housing 10; providing a fluid discharge element 15 having the fluid passage 15*a* which is introduced into the fluid discharge element 15 by separating machining, preferably by chip removing machining and/or material removal machining; and arranging the fluid discharge element 15 in the fluid path in the compressor housing 10 downstream of the compressor impeller 13.

According to an embodiment of the method according to the invention, the fluid discharge element 15, as is shown in FIGS. 2 to 3B, can be produced from a plurality of discharge element parts 16, 17, 18 which are stacked one on top of the other in axial direction AR of the radial compressor 1, these discharge element parts 16, 17, 18 being welded, soldered or screwed together.

The fluid passage 15*a* can be arranged in such a way that it extends into all three of the discharge element parts 16, 17, 18 as is shown in FIGS. 2 to 3B, wherein the cross section of the fluid passage 15*a* can increase (as is shown) or be constant (not shown) along its extension in circumferential direction UR.

The geometric shape for the fluid passage 15*a* can be generated in every discharge element part 16, 17, 18 individually (as is indicated in FIG. 3A) or in the discharge element parts 16, 17, 18 in the stacked state (as is indicated in FIG. 3B).

Compression-formed material, preferably rolled material, particularly sheet metal or metal plate, can be used as starting material for the fluid discharge element 15.

The invention claimed is:

1. A radial compressor comprising:

a compressor housing (10); a compressor shaft (30) rotatably supported in said compressor housing (10); at least one compressor impeller (13) arranged on said compressor shaft (30) in said compressor housing (10); a fluid discharge element (15) arranged downstream of a most downstream impeller of said at least one compressor impeller (13) in a fluid path in said compressor housing (10), said fluid discharge element (15) having a predetermined extension in a radial direction (RR) and in an axial direction (AR) of said radial compressor (10), said fluid discharge element (15) comprising a fluid passage (15*a*) for guiding fluid accelerated by said last compressor impeller (13) out of said compressor housing (10), said fluid passage (15*a*) extending in a circumferential direction (UR) of said radial compressor (1) by a predetermined angular amount, said fluid discharge element (15) formed of material having a defined material structure; and wherein said fluid passage (15*a*) is formed as a subsequently introduced spatial interruption in a material cohesion of said material structure; and wherein said fluid discharge element (15) is composed of a plurality of discharge element parts (16, 17, 18), each of said discharge element parts having an axial width, said fluid passage extending through said entire axial width of two of said plurality of discharge element parts and partially across the axial width of another of said discharge element parts, and said discharge element parts being stacked one upon the other and connected to one another in the axial direction (AR) of said radial compressor (1).

2. The radial compressor according to claim 1, wherein said discharge element parts (16, 17, 18) are connected to one another by one of welding, soldering and screwing.

3. The radial compressor according to claim 1, wherein said fluid passage (15*a*) comprises a cross section which is constant along its extension in the circumferential direction (UR).

4. The radial compressor according to claim 1, wherein said fluid passage (15*a*) comprises a fluid outlet (15*b*) and a cross section, said cross section increasing along its extension in the circumferential direction (UR) so that said fluid outlet (15*b*) of said fluid passage (15*a*) is arranged at a greatest cross section thereof.

5. The radial compressor according to claim 1, wherein said fluid discharge element (15) is made of a compression-formed material, and wherein said fluid discharge element (15) comprises a structure formed as a compression-formed material structure.

6. The radial compressor according to claim 5, wherein said material of said fluid discharge element (15) is a rolled material; and wherein said material structure of said fluid discharge element (15) is formed as a rolled material structure.

7. The radial compressor according to claim 6, wherein said rolled material is sheet metal or metal plate.

8. A method of producing a radial compressor comprising the steps of (a) providing a compressor housing (10), a compressor shaft (30) and at least one compressor impeller (13) arranged on the compressor shaft (30); (b) supporting the compressor shaft (30) rotatably in the compressor housing (10); (c) providing a fluid discharge element (15) and arranging the fluid discharge element in a fluid path in the compressor housing (10) downstream of a most downstream impeller of said at least one compressor impeller (13) of the radial compressor (1), the fluid discharge element (15) having a predetermined extension in a radial direction (RR) and in an axial direction (AR) of the radial compressor (1) and providing a fluid passage (15*a*) for conveying fluid accelerated by the last compressor impeller (13) out of the compressor housing (10), so that the fluid passage (15*a*) extends by a predetermined angular amount in a circumferential direction (UR) of the radial compressor (1); and (d) generating the fluid passage (15*a*) in the fluid discharge element (15) by means of separating machining; and step (c) is performed by stacking a plurality of separate discharge element parts (16, 17, 18) one upon the other and connecting the discharge element parts (16, 17, 18) to one another in such a way that the discharge element parts (16, 17, 18), each of said discharge element parts having an axial width, said fluid passage extending through said entire axial width of two of said plurality of discharge element parts and partially across the axial width of another of said discharge elements parts, and said discharge element parts being arranged one after the other in the axial direction (AR) of the radial compressor (1).

9. The method according to claim 8, wherein step (c) is performed by using solid material as starting material for the fluid discharge element (15).

10. The method according to claim 8, wherein step (d) is performed by one of chip-removing and material removal machining.

11. The method according to claim 8, wherein the discharge element parts (16, 17, 18) are connected by one of welding, soldering and screwing to one another.

12. The method according to claim 8, wherein the fluid passage (15*a*) is generated so that a cross section of the fluid passage (15*a*) is constant along its extension in the circumferential direction (UR).

13. The method according to claim 8, wherein the fluid passage (15*a*) is generated in such a way that a cross section of the fluid passage (15*a*) increases along its extension in the circumferential direction (UR) so that a fluid outlet (15*b*) of the fluid passage (15*a*) is arranged at a greatest cross section thereof.

14. The method according to claim 8, wherein step (c) performed by using compression-formed material as starting material for the fluid discharge element (15).

15. The method according to claim 14, wherein step (c) is performed by using rolled material as starting material for the fluid discharge element (15).

16. The method according to claim 14, wherein step (c) is performed by using sheet metal or metal plate.

* * * * *